US005787512A

United States Patent [19]

Knox

[11] Patent Number: 5,787,512

[45] Date of Patent: Aug. 4, 1998

[54] MATERNITY GARMENT, BLANKS AND METHOD FOR MAKING SAME

[75] Inventor: Samuel M. Knox, Hickory, N.C.

[73] Assignee: Alba-Waldensian, Inc., Valdese, N.C.

[21] Appl. No.: 608,277

[22] Filed: Feb. 28, 1996

[51] Int. Cl.[6] ..... A41B 11/00; A41B 11/14

[52] U.S. Cl. ..... 2/409; 66/171; 66/178 R; 66/169 R

[58] Field of Search ..... 2/409, 78.1, 78.2, 2/78.3, 78.4, 227, 408, 69, 69.5, 79, 239, 243.1; 66/171, 172 R, 173, 175, 176, 178 R, 194, 195, 196, 169 R, 197, 170, 198, 172, 199, 177, 179, 180, 181, 182, 183, 184, 185, 186, 187, 188, 189, 178 A, 191, 192, 193, 200, 201, 202, 169

[56] References Cited

U.S. PATENT DOCUMENTS

| | | | |
|---|---|---|---|
| 2,513,039 | 6/1950 | Miller . | |
| 2,632,177 | 3/1953 | Bigger . | |
| 2,697,925 | 12/1954 | Goodman | 66/177 |
| 2,983,128 | 5/1961 | Goff et al. | 66/178 |
| 3,080,869 | 3/1963 | Alberts | 450/155 X |
| 3,425,246 | 2/1969 | Knohl | 66/171 |
| 3,595,034 | 7/1971 | Safrit | 66/176 X |
| 3,694,816 | 10/1972 | Smith . | |
| 3,748,870 | 7/1973 | Fregeolle | 66/177 |
| 3,824,812 | 7/1974 | Matthews et al. | 66/177 |
| 4,976,653 | 12/1990 | White . | |
| 5,255,393 | 10/1993 | Brady . | |
| 5,465,594 | 11/1995 | Imboden et al. | 66/178 X |
| 5,479,791 | 1/1996 | Osborne | 66/171 |

FOREIGN PATENT DOCUMENTS

| | | | |
|---|---|---|---|
| 1537162 | 7/1967 | France | 66/177 |

*Primary Examiner*—Jeanette E. Chapman

*Attorney, Agent, or Firm*—Bell Seltzer Intellectual Property Law Group of Alston & Bird, LLP

[57] ABSTRACT

A garment having integrally knit underabdominal and back support panels is described. The garment desirably has a rear panel and a front panel which includes a substantially U-shaped support panel which is more resistant to stretch than the portion of the front panel which the substantially U-shaped panel surrounds, i.e. the abdominal section. The garment can be knit from a single or a pair of circularly knit tubular blanks, and preferably is formed so that the support panels are integrally knit with the garment. The abdominal section desirably has additional courses provided therein, in order to form a pouch area for accommodating the expanded abdominal region of a wearer. The garment also desirably includes an integrally knit back support panel which has a greater resistance to stretch than the abdominal section. In this way, when the garment is worn, the weight of the wearer's expanded abdominal region can be supported and distributed over a greater portion of his or her body. The garment can also include leg portions, to form a long-line panty, pantyhose, or the like.

29 Claims, 2 Drawing Sheets

MATERNITY GARMENT, BLANKS AND METHOD FOR MAKING SAME

BACKGROUND OF THE INVENTION

1. Field of the Invention

The invention generally relates to a maternity undergarment for comfortably supporting a wearer's growing abdomen, and a blank and method for making the same. More specifically, the invention relates to a circularly knit undergarment having integrally knit abdominal pouch, underbelly support, and back support panels, and a blank and method for making the undergarment.

2. Description of the Prior Art

Since their development, pantyhose and similar types of undergarments have been a source of much wearer discomfort and dissatisfaction. However, because stockings are seen to be aesthetically appealing, many wearers, particularly female wearers, are forced to endure the discomfort of such undergarments in order to present a proper and appealing appearance.

Typical pantyhose production involves the circular knitting of two tubular blanks, which are subsequently slit and joined together to form a lower torso portion. The blanks are then sewn closed at their respective toe portions, to form a completed pair of pantyhose. Such conventional pantyhose are usually relatively limited in their ability to stretch, causing them to be somewhat compressive on even slightly built wearers. Support versions of such pantyhose typically provide a greater degree of compression across the entire lower torso region of the wearer, and thus these versions are usually even more uncomfortable than the regular versions, even on less curvaceous wearers.

The discomfort associated with such conventional pantyhose can reach intolerable and even impractical levels for wearers having protruding abdominal regions, and particularly for pregnant women. Not only do such conventional pantyhose structures fail to fit comfortably, but expectant mothers tend to fear the ramifications to their babies' development from compression of the mother's abdomen during pregnancy. As a result, the only alternative for many expectant mothers who wish to achieve a "stockinged" appearance is to wear conventional knee high or thigh high stockings. Because these types of undergarments terminate on the leg, the overall appearance is not the same as that achieved with full pantyhose. Further, because the upper band of conventional knee high and thigh high stockings must be relatively tight in order that the stocking can be retained in the proper position when worn, the bands can tend to cut off the circulation to a wearer's leg. As a result, the formation of spider and varicose veins, which are typically a problem for pregnant and overweight persons, can be compounded, along with wearer discomfort.

Attempts have been made to produce close-fitting undergarments which can more comfortably accommodate a pregnant wearer's growing abdomen. For example, U.S. Pat. Nos. 2,513,039 and 2,632,177 to Miller and Bigger, respectively, disclose maternity panties. The patent to Miller describes a panty having a front abdominal-contacting panel which is longer, preferably by about 60%, than the panty back. In addition, the front panel is wider than the back panel, at least along an upper portion thereof. The panty can be fashioned from a knit fabric, from which front and back panels are cut and sewn together along side seams. Because the front panel is longer than the back panel, the front is gathered along the side seams, thereby resulting in the front panel having a convex configuration. The panty is designed to be retained in place solely by an elastic band which is sewn to the upper portion of the panty, and which exerts pressure in an inward and slightly downward direction on the abdominal region of the wearer.

The patent to Bigger describes a cut and sewn panty-type undergarment having an abdominal portion of extended length which is controlled by a pair of drawstrings along either side thereof. The remainder of the panty is of normal dimensions. The length of the abdominal portion is controlled by the pair of drawstrings to effect a greater length corresponding to the increasing abdominal size of a pregnant wearer. In this way, the panties can be selectively adjusted to fit the abdominal region as its dimensions change throughout pregnancy. Because the undergarments described in the Miller and Bigger patents must be cut and sewn, their production tends to be labor intensive and thus expensive.

Attempts have also been made to provide pantyhose which more comfortably accommodate the enlarged abdomen of a pregnant wearer. For example, U.S. Pat. No. 3,694,816 to Smith describes a maternity pantyhose garment made from first and second conventional circularly knit pantyhose blanks. The panty portion of each of the blanks is knit of stretchable yarn to provide substantial stretchability in the front and rear portions. Each of the blanks has a slit formed in the portion of the blank which will correspond to the side of the wearer's body when the pantyhose are completed, with a substantially U-shaped gusset panel being sewn into the slit. The U-shaped gusset panels are knit to have more restricted stretch than the panty portions of the blanks, in order that restricted stretch is provided at opposite sides of the panty portion of the completed pantyhose. The two blanks are joined together in the manner of conventional pantyhose, i.e. by way of a vertical seam extending along the center of the front and rear of the panty, and the pantyhose are finished by connecting an elastic waistband to the upper end of the pantyhose and seaming closed the open ends of the feet. However, the Smith patent fails to describe a means for providing back or underbelly support. Further, the additional cutting and sewing steps tend to increase the price of the pantyhose production.

U.S. Pat. No. 5,255,393 to Brady describes a form fitting garment designed to fit a wearer with a large abdomen, such as a pregnant woman. It is described that the garment can be a pantyhose garment, and that it includes a front panel across an abdominal region thereof. The panel is made from a more stretchable material than the rest of the garment, and may be variably supportive, i.e. have a lower region which is less elastic, a middle region of medium elasticity, and an upper region which is less supportive than the other regions. The garment includes side panels which are more stretchable than the remainder of the garment, and which may also be variably elastic from to bottom to top in the manner of the front panel. The garment also includes a waistband which is preferably both expandable and adjustable in order to accommodate the expanding body of a pregnant woman. Further, the garment can include a back panel which is more stretchable than the rest of the garment. The back panel can also be variably stretchable from bottom to top in the same manner as the front panel. Because the sides and back are described as being more stretchable than other portions of the garment, the weight of the wearer's pregnant abdomen would have a tendency to be concentrated proximate the abdominal region.

Thus, a need exists for lower-torso covering garments which provide enhanced comfort for wearers with large abdominal regions such as pregnant women, and which can be rapidly and efficiently manufactured using a minimal number of manufacturing steps.

SUMMARY OF THE INVENTION

It is therefore an object of the present invention to provide a lower-torso garment having an abdominal pouch for and support panels for comfortably accommodating and supporting a wearer's enlarged abdominal region, such as that of a pregnant woman.

It is a further object of the present invention to provide such a lower-torso garment by circular knitting, and which requires only a minimal number of finishing steps.

It is also an object of the present invention to provide a single blank and a pair of blanks which can be used to form a lower torso garment for accommodating and supporting a wearer's enlarged abdominal region, such as that of a pregnant woman.

It is a further object of the invention to provide a method of readily producing the blanks on a circular knitting machine.

These and other objects, features, and advantages are achieved by the present invention, which relates to circularly knit maternity undergarments having underbelly and back support. Though discussed specifically with reference to maternity undergarments, it is noted that the invention can readily be used from others who would benefit from the lift and support feature, such as overweight persons having enlarged abdominal regions. Further, the invention could be used by some wearers as an outer garment rather than an undergarment, e.g. as leggings for wear under a long sweater or as aerobic exercise apparel.

Garments according to the invention desirably include a waistband, preferably one which is produced on the knitting machine itself. In a particularly preferred form of the invention, the waistband is produced on a circular knitting machine in the form of a turned welt. A tubular lower torso covering portion is preferably knit to the waistband and defines front and rear panels for covering, respectively, the front and rear portions of a wearer's lower torso between the waist and the juncture of the thighs. The front and rear panels are desirably secured together about their respective first and second sides (thereby forming the tubular shape) and are further joined at a crotch region, to define first and second leg openings between the junctures of the sides and the crotch region. The garment can terminate proximate the leg openings, or can include partial or full leg portions. In this way, the invention can form, for example, a long-line panty or a pair of pantyhose.

The front panel desirably includes a pouch-like abdominal section which is preferably formed by knitting to produce a greater number of courses in the abdominal section than in the rest of the garment. For example, the portions of the garment other than the abdominal section could be knit on less than all of the needles of the knitting machine, with some of the inactive needles being brought into the knitting operation during the formation of the abdominal section. Because this abdominal section has a greater number of courses than the surrounding portions of the garment, a greater amount of material fullness is provided in this region. In this way, the abdominal region can more comfortably accommodate the stomach of a pregnant woman without the undue pressure often associated with conventional undergarments, and especially pantyhose.

The pouch-like abdominal section is preferably substantially surrounded by a substantially U-shaped support panel, which has a greater resistance to stretch than the abdominal section. In a preferred form of the invention, the support panel extends from proximate the waistband, with the bottom of the "U" of the support panel terminating proximate, and preferably somewhat above, the crotch region. In this way, the U-shaped support panel is adapted to follow the contours of a wearer's expanded abdominal region, to provide lifting support thereto. In the embodiment discussed above where the support panel extends substantially to the waistband, even greater support can be provided to the wearer's abdominal region, since the support extends substantially continuously from the waistband which is securely mated with the wearer's body. Further, because the waistband is typically worn above a wearer's hip bones, the weight of the wearer's expanded abdominal region tends to be distributed to these bones, rather than merely being supported by the soft tissue and skin of the abdominal region.

In a preferred form of the invention, the support panel is integrally knit with the other portions of the front panel of the undergarment. For example, welt or float knit stitches can be used to form the support panel, or an additional elastic yarn could be fed or knitted in while in an extended condition to affect the ability of the support panel to stretch.

A back support panel is also desirably provided on the rear panel of the undergarment, to provide support to the corresponding region of a wearer's body. The back support panel can be integrally knit with the rest of the garment in a similar manner to that used to form the substantially U-shaped support panel, such as by using welt or float knit stitches in that region. In a preferred form of the invention, the back support panel extends continuously across the rear panel of the garment and terminates proximate the U-shaped support panel. In this way, the weight of the expanded abdomen can be distributed across the sides and back of the wearer, thereby preventing the force of the abdominal load being concentrated in a single isolated area proximate the wearer's abdominal region. The back support panel preferably extends from the waistband and across the full expanse of the wearer's buttock region. The back support panel can terminate proximate leg portions (such as when the garment is in the form of pantyhose), or can terminate proximate the wearer's gluteal crease, i.e the curved crease located at the juncture of a person's buttocks and thighs. It will be noted, however, that the back support panel could extend over only a portion of the buttock region, depending on the desires of the manufacturer. Additionally, because the back support panel provides support to the lower back of the wearer, wearer comfort is enhanced, since the lower back is typically a region which suffers discomfort due to the burden of added weight proximate the abdominal region.

Other objects, features and advantages of the present invention will become apparent from the following detailed description when taken in conjunction with the accompanying drawings.

DETAILED DESCRIPTION OF THE PREFERRED EMBODIMENTS

Figure 1:
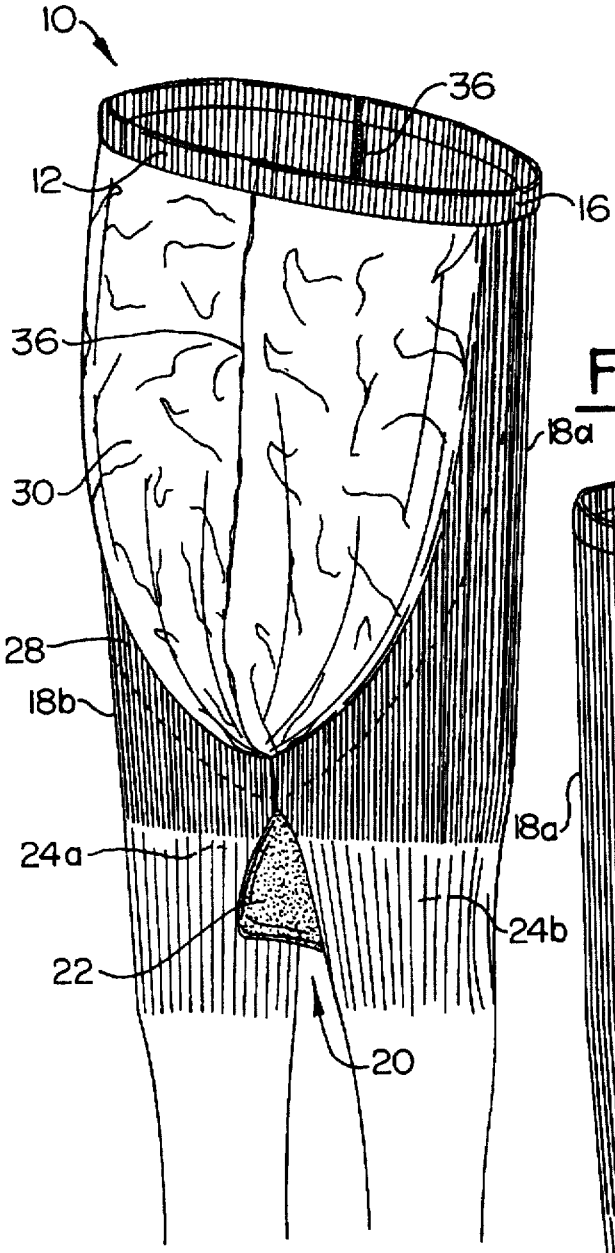
FIG. 1 is a front perspective view of an undergarment according to the present invention in the form of a pair of pantyhose.
Figure 2:
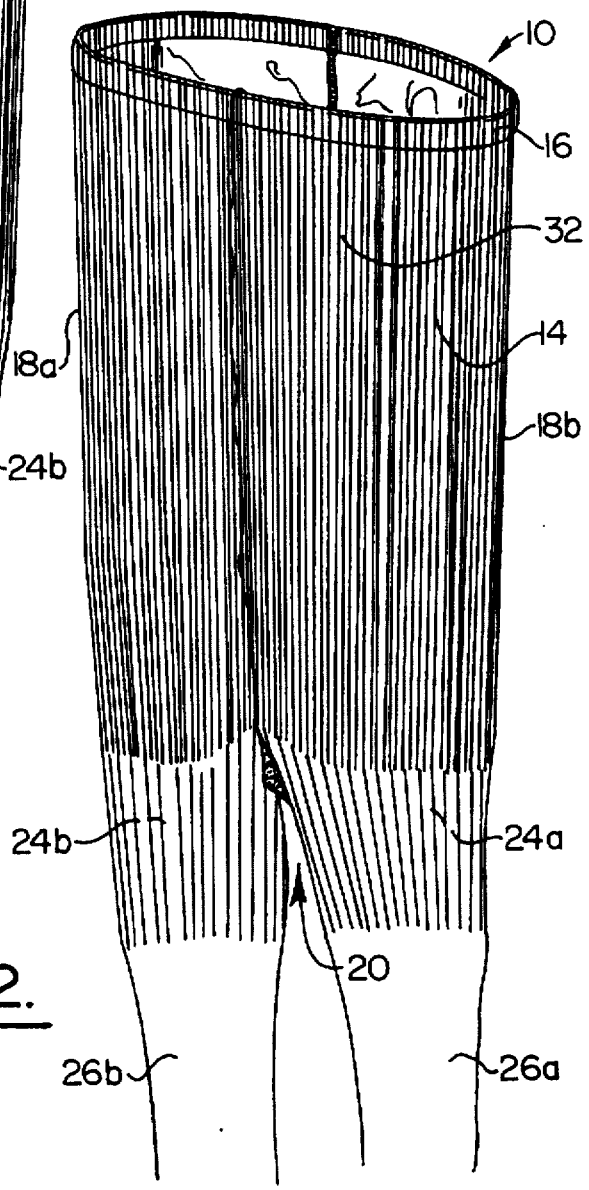
FIG. 2 is a rear perspective view of the pair of pantyhose illustrated in FIG. 1.

Referring now to the drawings, FIGS. 1 and 2 illustrate front and back views of a pair of pantyhose, shown generally at 10, made according to the present invention. The garment 10 desirably includes a front panel 12 adapted to cover at least a portion of the front of a lower torso of a wearer and a rear panel 14 adapted to cover at least a portion of the rear lower torso of a wearer, i.e., the buttocks region. The garment 10 desirably has a waistband 16 for encircling the waist of a wearer and maintaining the garment in its proper position when worn. In a preferred form of the invention, the waistband 16 is knit on a circular knitting machine. In a particularly preferred form of the invention, the waistband 16 is knit on a circular knitting machine in the form of a turned welt.

The front and rear panels 12, 14 are preferably integrally knitted together along their respective sides as illustrated at 18*a*, 18*b* to form a tubular body. The front and rear panels 12, 14 are also secured together proximate a crotch region, which is shown generally at 20. In a preferred form of the invention, the front and rear panels 12, 14 are sewn together at the crotch region 20. It is noted, however, that other methods of attaching the front and rear panels together proximate the crotch region could be utilized in accordance with the present invention. In a further preferred form of the invention, a crotch gusset 22 is secured between the front and rear panels 12, 14 in order to provide a roomier and more comfortable crotch construction for the wearer. In addition, the crotch gusset 22 can be formed from an absorbent and/or breathable material such as cotton or the like in order to enhance the comfort of the garment.

First and second leg openings 24*a*, 24*b* are thus formed between the front and rear panel sides 18*a*, 18*b* and the crotch region 20. The leg openings 24*a*, 24*b* are adapted to receive the legs of a wearer when the garment 10 is worn. The garment 10 may also include optional leg portions 26*a*, 26*b* which can extend to virtually any length, as desired. For example, the leg portions 26*a*, 26*b* can terminate proximate a wearer's thighs in the manner of a long line panty, or on the calf, proximate a wearer's ankle, or they may terminate in partial or full foot portions, as in the manner of conventional pantyhose. Alternatively, the undergarment can be made without leg portions 26*a*, 26*b*. In this embodiment, an elastic band or the like would desirably be secured proximate the leg openings 24*a*, 24*b* in order to secure the undergarment 10 about a wearer's legs.

A substantially U-shaped support panel 28 is desirably provided on the front panel 12 and preferably centered thereupon. A pouch-like abdominal section 30 is positioned within this U-shaped support panel 28. The abdominal section 30 preferably has added material fullness in order to accommodate an enlarged abdomen such as that belonging to a pregnant woman. In a preferred form of the invention, the abdominal section 30 is knit from a greater number of courses than are used to form the U-shaped support panel 28 surrounding the abdominal section. In this way, added material fullness is provided in the abdominal section 30 to form a pouch-like configuration.

The U-shaped support panel 28 is preferably knit to have a greater resistance to stretch, particularly course-wise stretch, than that of the abdominal section 30. In a preferred form of the invention, the substantially U-shaped support panel 28 terminates proximate the waistband 16 in order that continuous support is provided from the waistband to beneath the abdominal section 30. In this way, the weight associated with the enlarged abdomen of the wearer can be distributed over a wider region of the wearer's body, thereby relieving some of the stress associated therewith. In a preferred form of the invention, the substantially U-shaped support panel 28 terminates above the crotch region 20 of the garment 10 in order that it tends to follow the contours of an enlarged abdominal region of a wearer, which typically terminates above the crotch region of the wearer. In addition, when the substantially U-shaped support panel 28 terminates proximate the waistband 16, a portion of the weight associated with the enlarged abdomen of the wearer tends to be distributed above the hip bones, rather than merely being supported by the soft tissue and skin of the abdominal region. In this way, the load of the enlarged abdomen can be eased somewhat. In a preferred form of the invention, the support panel 28 is integrally knit with the other portions of the front panel 12 of the undergarment 10. For example, welt or float knit stitches can be used to form the support panel 28, and/or an additional elastic yarn can be fed or knitted into the fabric in an extended condition to thereby affect the ability of the support panel to stretch.

A back support panel 32 is desirably provided on the rear panel 14 in order to correspond to the back portion of a wearer's lower torso. In a preferred form of the invention, the back support panel 32 is adapted to correspond to the lower lumbar and upper buttock regions of a wearer's body. The back support panel 32 is desirably integrally knit with the other portions of the garment in substantially the same manner as the substantially U-shaped support panel 28, e.g., such as by using welt or float knit stitches in that region and/or providing an additional elastic yarn in an extended condition to effect the back support panel's extensibility. In a preferred form of the invention, the back support panel 32 extends across the entire width of the rear panel 14, around to the front panel 12, and terminates proximate the U-shaped support panel 28. In this way, continuous support can be provided from the front panel 12 of the garment 10 to the rear panel 14. In a particularly preferred form of the invention, the back support panel 32 extends from proximate the waistband 16 downward across the entire buttock region of the wearer and terminates at a lower edge 34, which is desirably located at or near the junction of the buttocks with the thighs, i.e., the gluteal crease. It is noted, however, that the back support panel 32 could cover a lesser portion of the rear panel 14, thereby concentrating the support at a lumbar region of the wearer immediately above the buttocks. In a preferred form of the invention, the back support panel lower edge 34 is curved to follow the contours of the gluteal crease.

The garment 10 also desirably includes a seam 36 which extends from a center portion of the front of the waistband 16, down through the front panel 12, through the crotch region 20 and up a center portion of the rear panel 14, terminating proximate the other side of the waistband 16. The seam 36 results from a preferred method of construction as will be discussed further herein with respect to the method of production.

Figure 3:
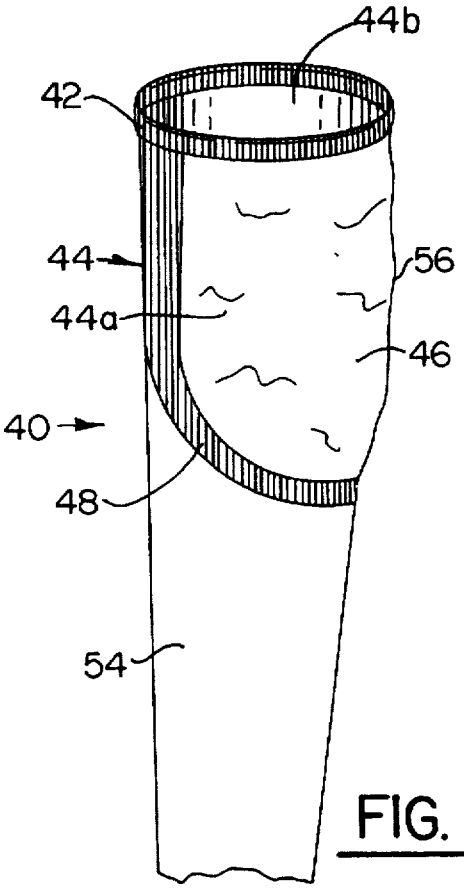
FIG. 3 is a perspective view of a front side of one embodiment of a blank according to the present invention.
Figure 4:
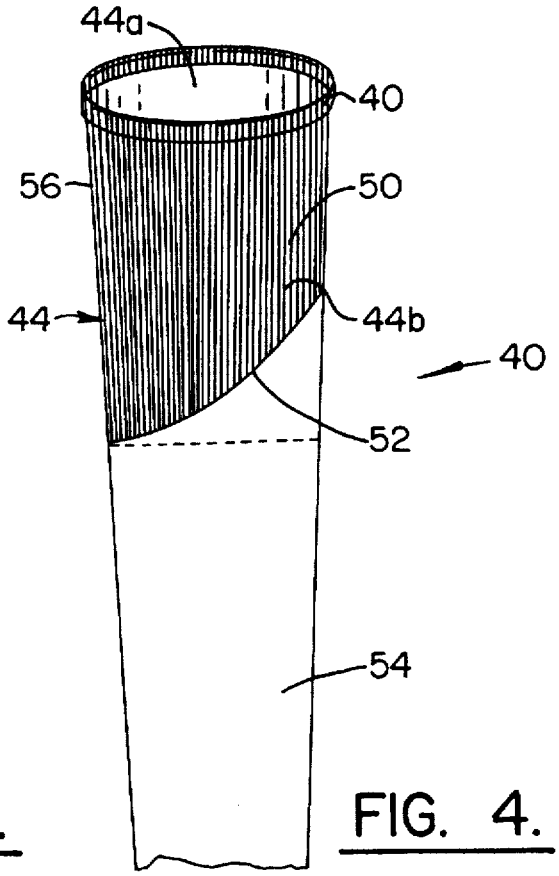
FIG. 4 is a perspective view of a rear side of the blank illustrated in FIG. 3.

FIGS. 3 and 4 illustrate a blank 40 according to the instant invention which can be used to form a garment similar to that illustrated in FIGS. 1 and 2. FIG. 3 illustrates a front side of the blank 40 while FIG. 4 illustrates a rear side of the blank. The blank 40 is desirably knitted on a circular knitting machine and includes a waistband 42 which is preferably produced on the knitting machine and more preferably produced in the form of a turned welt. A tubular lower torso portion 44 is integrally knit to the waistband portion 42 which will define a lower torso portion of the garment. The lower torso portion includes a front panel half 44a as shown in FIG. 3 and a rear panel half 44b as shown in FIG. 4. During the knitting of the blank 40, a portion of the front panel half 44a is desirably knit to include an abdominal section 46 which preferably has a greater amount of fullness than the portion immediately surrounding it. In a preferred form of the invention, this abdominal section 46 is knit from a greater number of courses than the surrounding portions of the blank 40, in order that the abdominal section can form a pouch-like section on the completed garment.

The blank 40 is desirably knit to form a support panel portion 48 which preferably substantially surrounds the abdominal section 46. In a particularly preferred form of the invention, this support panel portion 48 is in the shape of half of a U; in this way, when two substantially mirror-image blanks are joined together (as will be discussed further herein), the support panel has a substantially U-shaped configuration.

The rear panel half 44b of the lower torso portion 44 is desirably knit to include a back support panel 50. The support panel portion 48 and the back support panel portion 50 are desirably knit in the same manner such that they have a greater resistance to stretch, particularly course-wise stretch, than the abdominal section 46. For example, the support panel portion 48 and the back support panel portion 50 can be knit to include welt or float knit stitches or a supplemental elastic yarn could be fed in an extended form such that these portions of the garment tend to constrict upon release of the tension on the elastic yarn. In the embodiment illustrated in FIG. 4, the back support panel portion 50 terminates at a lower edge 52 which in this case is curved in order that it will closely correspond to the gluteal crease region of the wearer. The lower edge 52 could also extend substantially straight across the blank 40 in order to form a garment similar to that illustrated in FIG. 2. A leg forming portion 54 is then desirably knit to the lower torso portion 44, which can then form the leg portions of the completed garment. In a preferred form of the invention, a non-raveling edge (not shown) is provided at a lower portion of the blank 40 in order that the blank does not have a tendency to ravel when it is transferred from its production point to the position where the blanks are formed into a garment.

Production of a garment from the blank illustrated in FIGS. 3 and 4 is performed as follows. A first blank 40 as illustrated in FIGS. 3 and 4 is produced and a second blank (not shown) which is desirably the mirror image of the blank illustrated in FIGS. 3 and 4 is also produced. Each of these blanks is then slit along a side which will form a center of the front panel 12 and the center of the rear panel 14 of the completed garment, as is shown at 56 in FIGS. 3 and 4. The first and second blanks are then seamed or otherwise secured together such that a front panel half 44a of one blank is joined to the front panel half of the other blank, and a rear panel half 44b of one of the blanks is joined to the rear panel half of the other blank, in a manner similar to that used in the formation of conventional pantyhose. A supplemental crotch gusset, as illustrated at 22 in FIG. 1, can also be provided between the blank halves as desired to enhance the comfort and fit of the garment.

Figure 5:
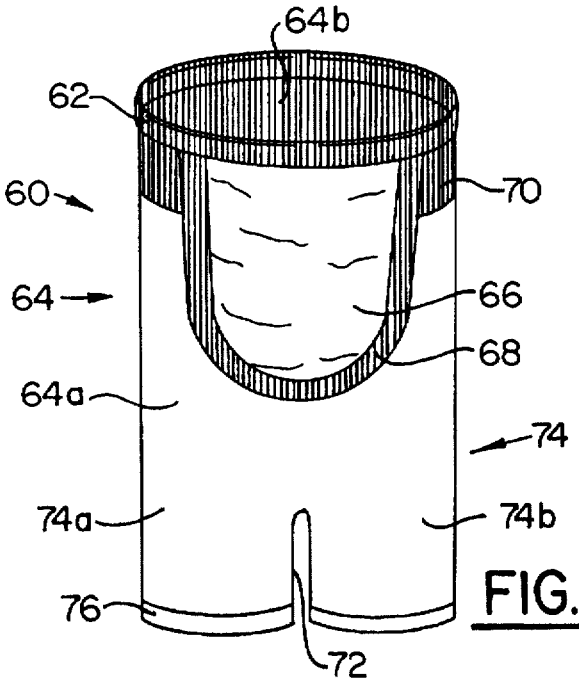
FIG. 5 is a perspective view of a garment according to the present invention in the form of a long-line panty.

FIG. 5 illustrates an alternative form of the invention, in the form of a long-line panty 60. In this form of the invention, the entire garment is knit in one piece on the knitting machine and requires only a single subsequent cutting and seaming operations, which can be performed simultaneously. The garment is preferably knit to have a waistband 62 at its upper end which is preferably in the form of a turned welt. A lower torso portion 64 is preferably knit to this waistband 62 and includes a front panel 64a and a rear panel 64b. The front panel 64a is desirably knit to include an abdominal section 66 which is substantially surrounded by a substantially U-shaped support panel 68, in the manner previously described with reference to the other figures. More specifically, the abdominal section 66 is desirably knit from a greater number of courses than the surrounding portions of the garment blank, to provide a pouch area having a greater amount of material fullness. The substantially U-shaped support panel is preferably knit to substantially surround the abdominal section, and is knit so that it has a greater resistance to stretch than the abdominal section.

A back support panel 70 is desirably knit into the rear panel portion 64b to provide support for a wearer's back. As can be seen in FIG. 5, the back support panel 70 in this embodiment is adapted to cover only a portion of wearer's lumbar and upper buttock region, when the blank is formed into a completed garment. A leg forming portion, shown generally at 74, is desirably knit in tubular form to extend downwardly from the lower torso portion 64. The blank is then desirably completed by forming a non-raveling edge proximate its lower end. In a particularly preferred form of the invention, the non-raveling edge is in the form of a turned welt, in order that the turned welt can serve as leg bands 76 in the completed garment.

To form this blank into a completed garment 60, the front and rear panels 62, 64 are seamed together along a curved seam 72 to form first and second leg portions 74a, 74b. The portion of the blank material located between the leg portions 74a, 74b is desirably removed and discarded. In a particularly preferred form of the invention, the cutting and seaming is performed simultaneously, such as by an undertrimmer sewing machine, with the seaming being performed while the blank is in an inverted condition, in order that the seamed edge will be located on the interior of the garment. If desired, a supplemental crotch gusset could also be provided in a conventional manner.

In the drawings and the specification, there has been set forth a preferred embodiment of the invention, and although specific terms are employed, they are used in a generic and descriptive sense only and not for purposes of limitation, the scope of the invention being defined in the claims.

That which is claimed is:

1. A method of making a blank for a lower torso garment having an abdominal pouch and a support panel for lifting and supporting an abdominal region of a wearer comprising the steps of:

knitting a series of courses to form a continuous tubular structure, and periodically modifying the series of courses to form a discrete pouch area defined by additional courses being fed therein adding material fullness in the pouch area, to form an elongate curved section substantially surrounding a portion of the pouch area, such that the curved section has a greater resistance to stretch than the pouch area, and to form a crotch region extending from and having a lesser resistance to stretch than said elongate curved section.

2. The method according to claim 1, wherein said step of knitting a series of courses to form a tubular structure comprises knitting a tubular structure defining front and rear garment panel halves, and said step of modifying the series of courses to form an elongate curved section comprises modifying the series of courses on the front garment panel half to form a walewise extending strip having a curved lower end.

3. The method according to claim 2, further comprising the step of periodically modifying the series of courses on the rear garment panel half to form a back support section having a greater resistance to stretch than the pouch area.

4. The method according to claim 1, wherein said step of knitting a series of courses to form a tubular structure comprises knitting a tubular structure defining front and rear garment panels, and said step of modifying the series of courses to form an elongate curved section comprises modifying the series of courses on the front garment panel to form a substantially U-shaped section having a greater resistance to stretch than the pouch area.

5. The method according to claim 4, further comprising the step of periodically modifying the series of courses on the rear garment panel to form a back support section having a greater resistance to stretch than the pouch area.

6. The method according to claim 1, wherein said step of periodically modifying the series of courses comprises floating in an elastic yarn in the elongate curved section.

7. The method according to claim 1, wherein said step of periodically modifying the series of courses comprises holding a yarn used to form the series of courses in selected alternating courses forming the elongate curved section.

8. The method according to claim 1, further comprising knitting a series of courses in the form of a turned welt to the tubular structure proximate an upper end thereof.

9. The method according to claim 1, further comprising knitting to the tubular structure a series of courses defining a leg forming portion of a garment, then knitting to the leg forming portion a series of courses defining a non-raveling edge.

10. The method according to claim 9, wherein said step of knitting a series of courses defining a non-raveling edge comprises knitting a turned welt to the leg forming portion.

11. A circularly knit blank for the manufacture of a lower torso garment having an abdominal pouch and a support panel for lifting and supporting an abdominal region of a wearer comprising:

a continuous knit tubular body comprising a discrete pouch area formed by a greater number of knit courses than a surrounding area of the blank, to provide added material fullness thereto, an elongate curved section substantially surrounding a portion of the pouch area, said elongate curved section being knitted to have a greater resistance to stretch than said pouch area, and a crotch region knit to and having a lesser resistance to stretch than said elongate curved section.

12. The blank according to claim 11, wherein said knit tubular body defines front and rear garment panel halves, and said elongate curved section is positioned on said front garment panel half and includes a walewise extending strip having a curved lower end.

13. The blank according to claim 12, further comprising a back support section having a greater resistance to stretch than said pouch area positioned on said rear garment panel half.

14. The blank according to claim 11, wherein said knit tubular body defines front and rear garment panels, and said elongate curved section is positioned on said front garment panel and is substantially U-shaped.

15. The blank according to claim 14, further comprising a back support section having a greater resistance to stretch than said pouch area positioned on said rear garment panel.

16. The blank according to claim 11, further comprising a series of courses defining a cylindrical tubular fabric portion in the form of a turned welt located proximate an upper end of said knit tubular body, and a series of courses defining a leg forming portion located proximate a lower end of said knit tubular body.

17. A method of making a lower torso garment having an abdominal pouch and support panel for lifting and supporting an abdominal region of a wearer comprising the steps of:

knitting a series of courses to form a tubular structure, and periodically modifying the series of courses to form a discrete pouch area defined by additional courses being fed therein adding material fullness in the pouch area, and to form an elongate curved section substantially surrounding a portion of the pouch area, such that the curved section has a greater resistance to stretch than the pouch area, then knitting a series of courses to the tubular structure defining a leg forming portion of a garment, then cutting and removing from the leg forming portion first and second spaced fabric portions to define front and rear garment panels, each panel including first and second leg portions, and attaching front and rear garment panels together along and between the first and second leg portions, to thereby form a completed garment.

18. The method according to claim 17, further comprising, prior to said cutting and removing step, knitting a cylindrical tubular fabric portion in the form of a turned welt to an upper portion of the tubular structure, and one to a lower portion of the leg forming portion, to thereby form band forming portions for securing the garment on a wearer's body.

19. A method of making a lower torso garment having an abdominal pouch and support panel for lifting and supporting an abdominal region of a wearer comprising the steps of:

knitting a series of courses to form a first continuous tubular structure, while periodically modifying the series of courses to form a discrete pouch area defined by additional courses being fed therein adding material fullness in the pouch area, to form an elongate curved section substantially surrounding a portion of the pouch area, such that the curved section has a greater resistance to stretch than the pouch area, and a crotch region extending from and having a lesser resistance to stretch than the elongate curved section, then knitting a series of courses to form a second tubular structure which is the substantial mirror-image of the first tubular structure, then slitting each of the tubular structures longitudinally to define front and rear garment panel halves on each of the tubular structures, and attaching the front garment panel half of the first tubular structure to the front garment panel half of the second tubular structure, and attaching the rear garment panel half of the first tubular structure to the rear garment panel half of the second tubular structure, and attaching the structures together at their respective crotch regions, to thereby form a garment.

20. A garment for lifting and supporting the abdomen of a wearer comprising:

a knitted front panel adapted to cover at least a portion of a front of a wearer's body between the waist and juncture of the thighs;

a rear panel connected to said front panel along first and second front and rear panel sides and a crotch region to define first and second leg openings, said rear panel being adapted to cover at least a portion of a wearer's buttocks, a crotch region joining said front and rear panels and adapted to cover a corresponding region of a wearer's body, said knitted front panel including an integrally knit pouch-shaped abdominal section substantially surrounded by a generally U-shaped support panel, said abdominal section including a greater number of courses per inch than said generally U-shaped support panel and said support panel having a greater resistance to stretch than said abdominal section, and said generally U-shaped support panel being positioned between said abdominal section and said crotch region, to provide lift and support to a wearer's abdomen.

21. The garment according to claim 20, wherein said front and rear panels are divided into respective first and second halves by a seam extending therebetween, and a first half of said front panel is integrally knit with a first half of said rear panel, while a second half of said front panel is integrally knit with a second half of said rear panel.

22. The garment according to claim 20, wherein said rear panel includes a back support panel which has a greater resistance to stretch than said abdominal section, to thereby provide support for a wearer's back.

23. The garment according to claim 20, wherein said back support panel is adapted to cover substantially the entire buttocks region of a wearer.

24. The garment according to claim 23, wherein said back support panel extends substantially continuously from said generally U-shaped support panel.

25. The garment according to claim 20, further comprising a waistband secured about upper ends of said front and rear panels to extend circumferentially about an upper end of said garment, and wherein said generally U-shaped support panel terminates proximate said waistband, to provide continuous support from below said abdominal section to said waistband.

26. The garment according to claim 25, wherein said waistband is integrally knit to said front and rear panels in the form of a turned welt.

27. The garment according to claim 20, wherein said generally U-shaped support panel includes an elastic yarn floated into its fabric structure.

28. The garment according to claim 20, further comprising leg covering portions integrally knit to said leg openings.

29. A garment for providing support for a wearer's abdominal region comprising:

a front panel for covering at least a portion of the lower front torso of a wearer and a rear panel for covering at least a portion of the lower rear torso of a wearer, said front panel including an integrally knit first substantially U-shaped support panel surrounding an integrally knit abdominal section, said substantially U-shaped support panel having a greater resistance to stretch than said abdominal section, to provide support for a protruding abdominal region of a wearer, and a crotch region integrally knit with said substantially U-shaped support panel on said front panel and joining said front panel to said rear panel, said crotch region having a lesser resistance to stretch than said substantially U-shaped support panel, and said rear panel including an integrally knit back support panel having a greater resistance to stretch than said abdominal section, to thereby provide support for a wearer's back.

* * * * *